US006561472B2

(12) United States Patent
Mongaras

(10) Patent No.: US 6,561,472 B2
(45) Date of Patent: May 13, 2003

(54) SUPPORT SYSTEM FOR CUBICLES

(76) Inventor: Valarie Mongaras, 8612 Mediterranean Dr., Dallas, TX (US) 75238

( * ) Notice: Subject to any disclaimer, the term of this patent is extended or adjusted under 35 U.S.C. 154(b) by 0 days.

(21) Appl. No.: 10/008,178

(22) Filed: Nov. 13, 2001

(65) Prior Publication Data

US 2002/0084392 A1 Jul. 4, 2002

Related U.S. Application Data

(63) Continuation-in-part of application No. 09/415,704, filed on Oct. 11, 1999, now abandoned.

(51) Int. Cl.[7] ..... A47B 96/06
(52) U.S. Cl. ..... 248/218.2; 248/216.1
(58) Field of Search ..... 248/684, 546, 248/475.1, 489, 493, 497, 498, 216.1, 217.1, 217.3, 218.1, 218.2, 218.3, 302, 316.7; 24/555, 564, 351, 711, 710.6, 6, 66.3, 103, 711.4; D19/65, 711.4, 711.3, 706, 86; 411/473, 498, 923, 457; D8/392, 393; D6/307, 338; D11/207; 63/37, 26

(56) References Cited

U.S. PATENT DOCUMENTS

| | | | | | |
|---|---|---|---|---|---|
| D22,823 | S | * | 10/1893 | McGill | D19/65 |
| 816,095 | A | * | 3/1906 | House | 411/473 |
| D58,442 | S | * | 7/1921 | Jasus | |
| 1,645,500 | A | * | 10/1927 | Fenton | 24/711 |
| D218,582 | S | * | 9/1970 | Kiester | |
| 3,983,995 | A | * | 10/1976 | Readyhough | 206/343 |
| D243,580 | S | * | 3/1977 | DeCaro | D8/388 |
| 6,305,057 | B1 | * | 10/2001 | Seum | 24/711 |

* cited by examiner

*Primary Examiner*—Kimberly Wood
*Assistant Examiner*—Gwendolyn Baxter
(74) *Attorney, Agent, or Firm*—Michael A. O'Neil

(57) ABSTRACT

In a first embodiment a support system for cubicles comprises a handle having a document engaging surface and a document and fabric penetrating member including a first relatively short horizontally disposed portion and a second relatively long vertically disposed portion which extends to a fabric penetrating tip. In a second embodiment the support system for cubicles includes a hook, a pair of fabric engaging members extending outwardly from the hook, and a pair of fabric penetrating members extending downwardly from the fabric engaging members to fabric penetrating tips.

4 Claims, 5 Drawing Sheets

SUPPORT SYSTEM FOR CUBICLES

This application is a continuation-in-part of application Ser. No. 09/415,704, filed Oct. 11, 1999, now abandoned.

BACKGROUND AND SUMMARY OF THE INVENTION

As is well known, modern offices, colleges, and similar institutions typically employ cubicles which serve as workstations, study corrals, etc. Such cubicles are constructed from a plurality of interlocking panels which are provided in a variety of heights and widths. Thus, simply by selecting the appropriate panels, cubicles having any desired length and width dimensions and affording greater or lesser degrees of privacy are readily constructed and/or reconfigured.

The panels that are utilized in cubicle construction typically have at least one side which is covered with a woven fabric. The use of fabrics to cover at least the interior walls of cubicles affords a greater sense of luxury than would otherwise be the case, and also provides sound deadening to the point that the interior of the cubicle is relatively quiet notwithstanding the level of external noise. Typically the fabric covering overlies a resilient layer which further enhances the visual appearance and sound deadening qualities of the cubicle.

Unfortunately, the use of fabrics with resilient backings as the interior surface of cubicles virtually prevents the use of conventional thumb tacks and push pins, for supporting single sheet documents; multi-sheet documents such as calendars, dockets, reports, etc.; and pictures and framed photographs within the cubicles. This is because the resilient backing of the fabric exterior layer has a sufficient thickness to prevent thumb tacks, push pins, and the like from securely engaging the underlying surface. The use of enlarged thumb tacks, push pins, etc. is negated by the fact that the necessary increase in diameter would produce unacceptably large holes in the exterior fabric.

The present invention comprises a support system for cubicles which overcomes the foregoing and other disadvantages which have long since characterized the prior art. In accordance with one embodiment of the invention, there is provided an apparatus for supporting articles within cubicles of the type comprising a fabric layer having a resilient backing which includes a handle extending to a fabric engaging surface and a fabric penetrating pin extending from the fabric engaging surface and including a relatively short first portion extending perpendicularly from the fabric engaging surface and a relatively long second portion extending perpendicularly from the first portion and parallel to the fabric engaging surface. The second portion of the pin extends to a sharp point which is directed through the article to be supported, through the fabric layer, then downwardly into the resilient backing. As the second portion of the pin moves downwardly into the resilient layer, it is followed by the first portion of the pin which provides a nominally horizontally disposed support for the article being supported. Movement of the pin into the resilient layer continues until the article engaging surface of the handle presses the article being supported firmly into engagement with the underlying fabric layer.

In accordance with a second embodiment of the invention, a support system for cubicles comprises a hook adapted to support multi-page documents, pictures, framed photographs, and other, similar relatively heavy items. The hook is centrally disposed between a pair of fabric engaging arms which extend laterally outwardly from the hook and which are positioned in a nominally horizontal orientation. The arms extend to downwardly directed, vertically oriented fabric penetrating members which in turn extend to sharp points. In the use of the second embodiment of the invention the points of the fabric penetrating members are extended through the fabric and into the resilient backing of the wall of a cubicle. Penetration continues until the arms engage the fabric whereupon the hook is positioned to receive and support multi-page documents, pictures, framed photographs, and the like.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
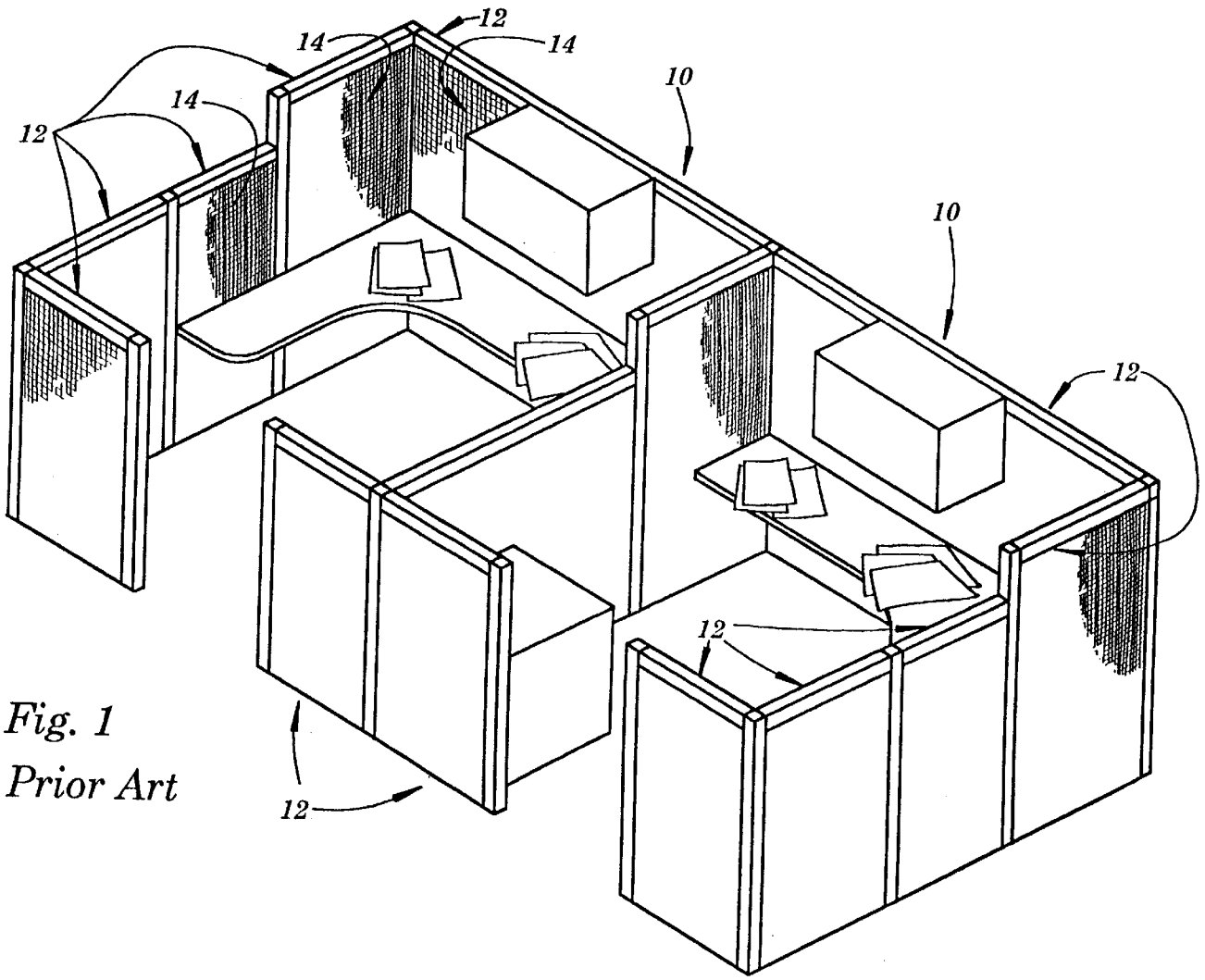
Fig. 1 Prior Art
FIG. 1 is a perspective view illustrating cubicles of the type typically employed in offices, schools and colleges, etc.

Referring now to the Drawings, and particularly to FIG. 1 thereof, there is shown a pair of cubicles 10 of the type commonly employed in offices, schools and colleges, etc. Each cubicle 10 is comprised of a plurality of interconnected panels 12. As clearly illustrated in FIG. 1, the panels 12 are available in a wide variety of widths and heights. In this manner each cubicle 10 may enclose virtually any desired area depending on the anticipated application of the cubicle. Likewise, each cubicle 10 may be afforded a greater or lesser degree of privacy, again dependent upon the anticipated utilization of the cubicle.

The panels 12 comprising the cubicles 10 are most often provided with at least an interior surface 14 comprising a fabric layer. The use of fabric as the interior surface of the panels 12 comprising the cubicles 10 affords a feeling of luxury and also provides sound deadening qualities so that the noise level within the cubicle is reduced substantially as compared with that of the surrounding environment. Behind the fabric layer 14 of each panel 12 there is provided a resilient layer which affords dimension to the interior surface of the cubicle, enhances the sense of luxury within the cubicle, and further enhances the sound deadening qualities of the fabric layer.

Because of the use of the fabric as the interior surface of the panels 12 comprising the cubicles 10 and particularly due to the use of a resilient layer behind the fabric, conventional thumb tacks, push pins, and the like cannot be used to secure single page documents, multi-page documents, pictures, photographs, and the like to the interior surfaces of the panels 12. This is due in part to the thickness of the resilient material and is also due in part to the fact that the surface underlying the resilient material may be sufficiently hard and/or dense so as to prevent penetration by thumb tacks, push pins, and the like.

Figure 2:
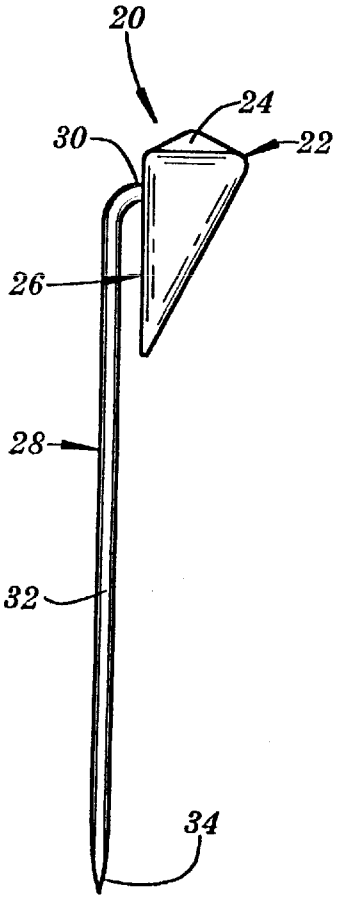
FIG. 2 is a perspective view illustrating a support system for cubicles comprising a first embodiment of the invention.

Referring to FIG. 2, there is shown a support system for cubicles 20 comprising a first embodiment of the invention. The system 20 includes a handle 22 which may be formed from any of the wide variety of plastics, utilized in the manufacture of household items, wood, ceramics, various metals, etc. The handle 22 preferably has a nominally horizontally disposed upper surface 24 which is useful in engagement of the system 20 with the fabric-covered wall of a panel comprising a cubicle. The handle 22 further includes a nominally vertically disposed fabric engaging surface 26.

The support system 20 further includes a fabric and resilient layer penetrating member 28. The member 28 includes a first relatively short portion 30 and a second relatively long portion 32. The first portion 30 extends outwardly from the handle 22 perpendicularly to the fabric engaging surface 26. The second portion 32 extends perpendicularly from the first portion 30 and parallel to the fabric engaging surface 26. The second portion 32 terminates in a sharp fabric penetrating tip 34. Preferably the second portion 32 is about 15 times longer than the first portion 30.

Figure 3:
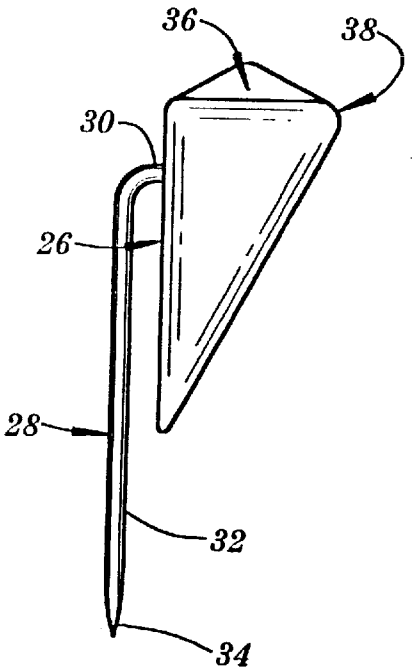
FIG. 3 is a view similar to FIG. 2 illustrating a support system for cubicles comprising a first variation of the first embodiment of the invention.

FIG. 3 illustrates a support system for cubicles 36 comprising a variation of the first embodiment of the invention. The system 36 is identical to the system 20 illustrated in FIG. 2 and described hereinabove in conjunction therewith except that the system 36 includes a handle 38 which is substantially larger than the handle 22 of the system 20. Thus, the system 36 is adapted for use by children, persons having arthritic conditions, and others that may have difficulty grasping the relatively small handle of the system 20.

Figure 4:
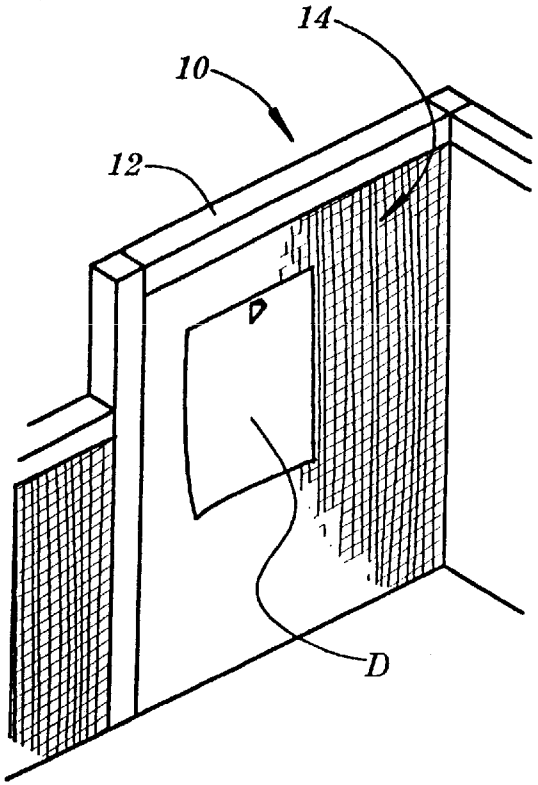
FIG. 4 is a partial perspective view illustrating a typical utilization of the first embodiment of the invention.
Figure 4:
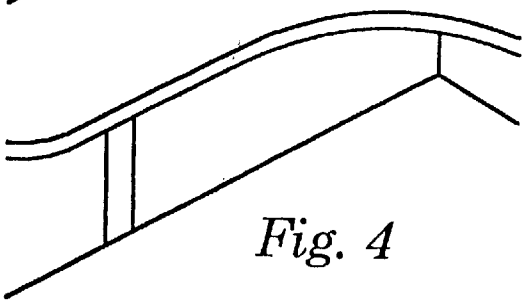

The use of the first embodiment of the invention is illustrated in FIG. 4. A single page document D is positioned at a desired location on the fabric comprising the interior surface 14 of a panel 12 comprising a cubicle 10. Either the support system 20 or the support system 36 is oriented as illustrated in FIGS. 2 and 3. The tip 34 is directed through the document D and through the fabric comprising the interior surface 14 of the panel 12 and into the resilient material underlying the fabric. The second portion 32 of the member 28 follows the tip 34 through the penetration thus formed in the document D and the underlying fabric and into the resilient layer positioned behind the fabric. This system 20 is moved substantially vertically downwardly until the first portion 30 of the member 28 engages the penetration through the document D and the underlying fabric. Thereafter the support system for cubicles moves horizontally as the first portion 30 of the member 28 moves through the penetration of the document D and the underlying fabric until the surface 26 of the handle 22 engages the document D. At this point the support system 20 is securely engaged in the fabric comprising the interior surface 14 of the panel 12 and the underlying resilient layer, thereby securely retaining the document D at the desired location. It will be understood that the document D is supported on the nominally horizontally disposed first portion 30 of the member 28 so that the document D does not move downwardly relative to the panel 12.

Figure 5:
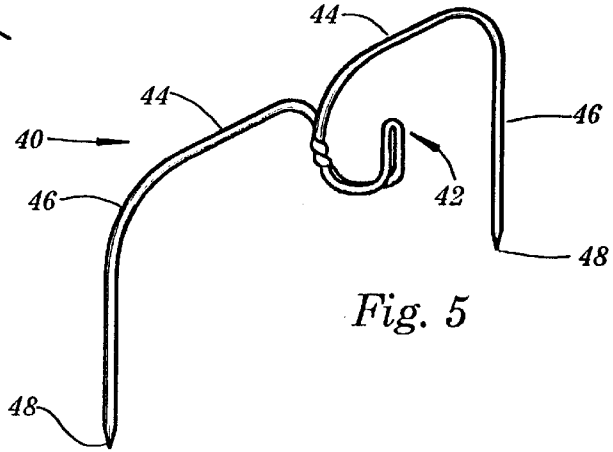
FIG. 5 is a perspective view illustrating a support system for cubicles comprising a second embodiment of the invention.

Referring to FIG. 5, there is shown a support system for cubicles 40 comprising a second embodiment of the invention. The support system 40 includes a hook 42 adapted to engage and support a variety of articles such as multi-page documents, pictures, framed photographs, etc. A pair of fabric engaging arms 44 extend outwardly from the hook 42 in opposite directions. Each arm 44 extends to a nominally vertically disposed fabric penetrating member 46 which in turn extends to a fabric penetrating tip 48.

In the use of the support system 40, the tips 48 are simultaneously engaged with the fabric comprising the interior surface 14 of a panel 12 of a cubicle 10. The tips 48 penetrate through the fabric and into the underlying resilient layer. The fabric penetrating members 46 follow the tips 48 through the fabric and into the underlying resilient layer. Inward movement of the tips 48 and the members 46 continues until the arms 44 engage the fabric comprising the interior surface 14 of the panel 12.

Engagement of the members 46 with the resilient layer underlying the fabric comprising the interior surface of the panel 12 secures the support system 40 thereto. Thereafter, the hook 42 is used to receive multi-page documents, pictures, and framed photographs, etc.

Figure 7:
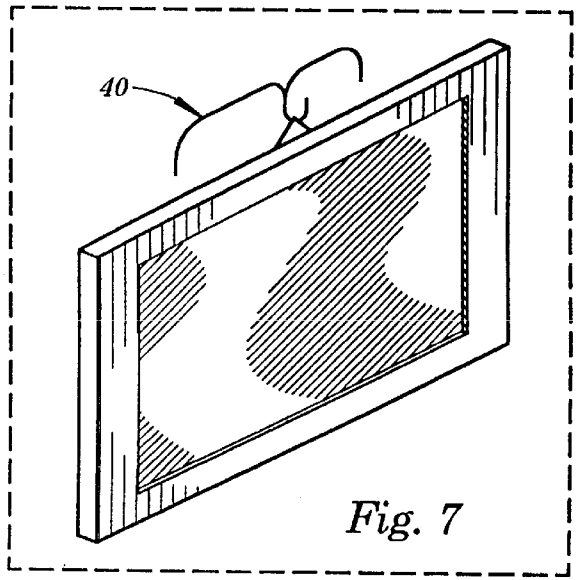
FIG. 7 is a perspective view illustrating another typical application of the second embodiment of the invention.
Figure 6:
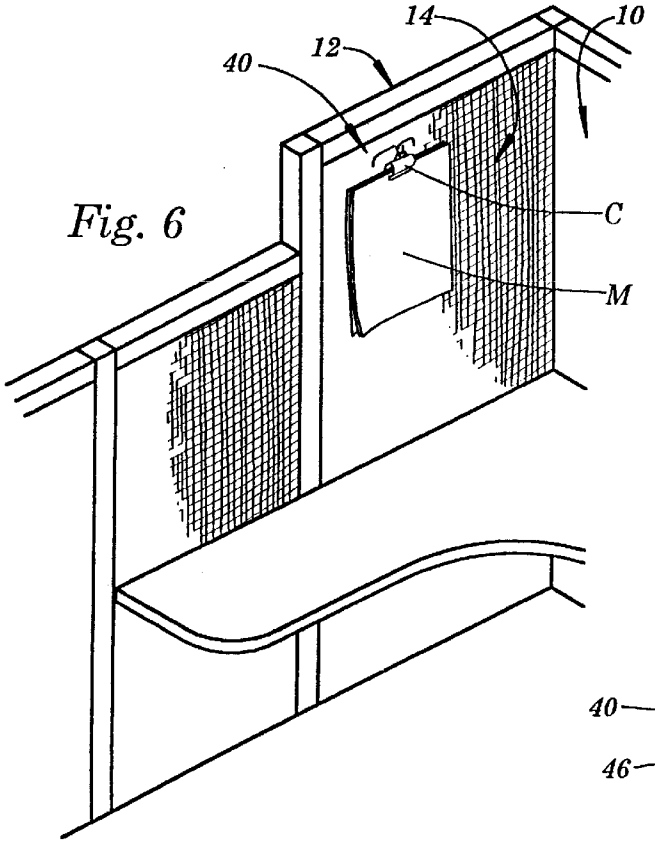
FIG. 6 is a perspective view illustrating a typical utilization of the second embodiment of the invention.

As is illustrated in FIG. 6, a conventional clip C may be used to support a multi-page document M on the support system 40. Alternatively, a multi-page document such as a calendar, agenda, report, etc. may be provided with a hole extending therethrough which receives the hook 42. FIG. 7 illustrates the use of the support system 40 to support a picture, framed photograph, etc.

Figure 10:
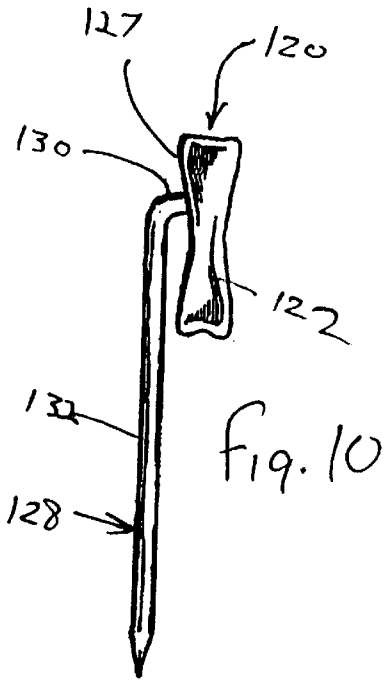
FIG. 10 is a side view of the apparatus of FIG. 8.
Figure 8:
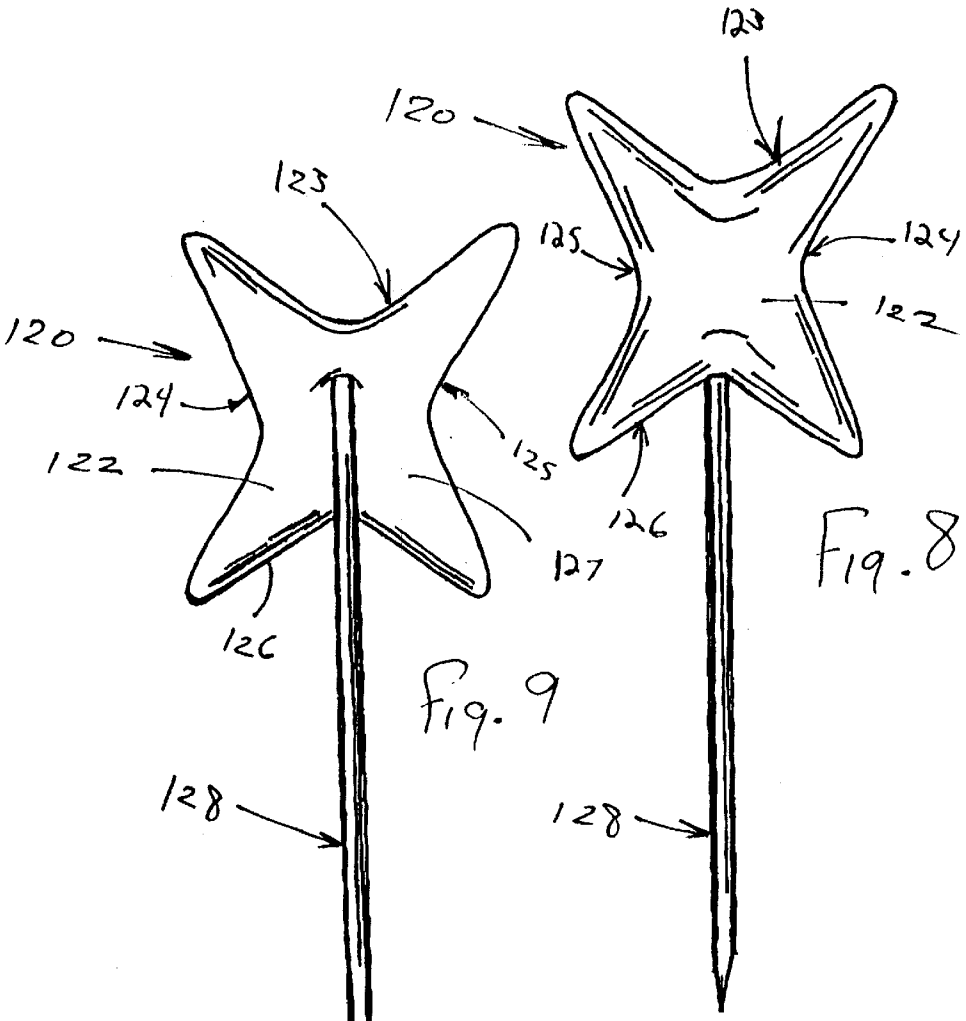
FIG. 8 is a front view illustrating a support system for cubicles comprising a second variation of the first embodiment of the invention.
Figure 9:
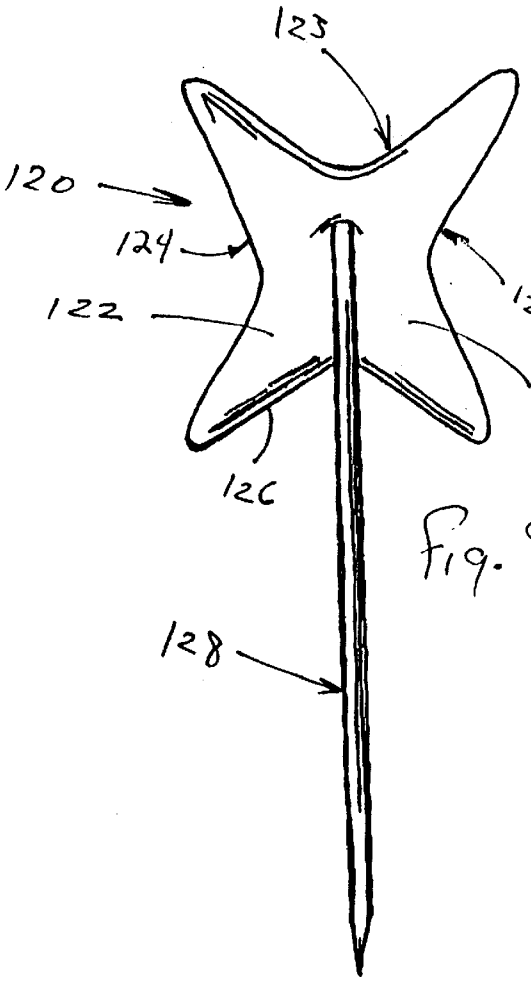
FIG. 9 is rear view of the apparatus of FIG. 8.
Figure 14:
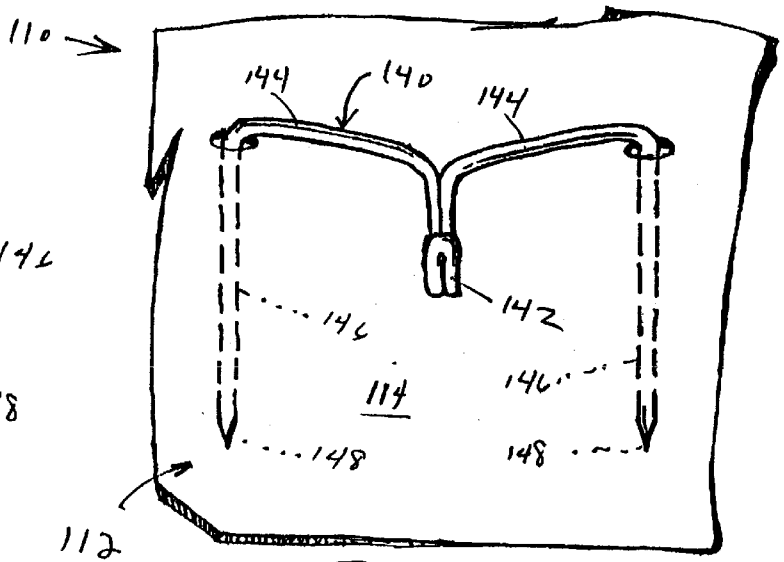
FIG. 14 is a diagrammatic illustration of the use of the apparatus of FIG. 11.
Figure 12:
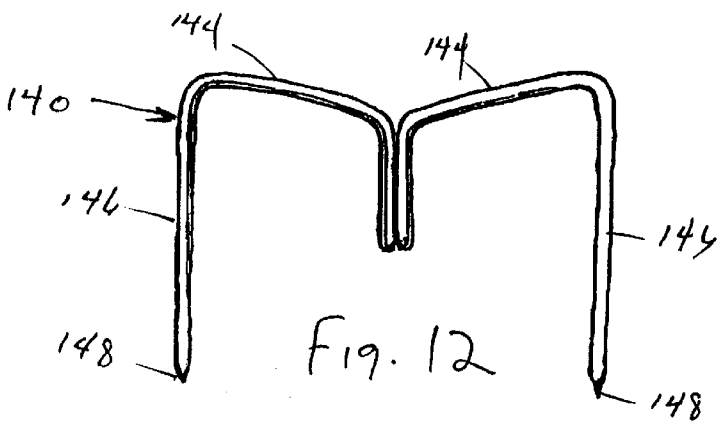
FIG. 12 is rear view of the apparatus of FIG. 11.
Figure 11:
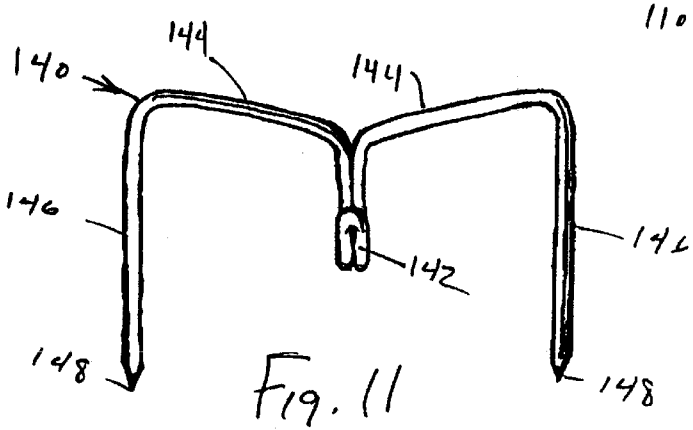
FIG. 11 is a front view of a support system for cubicles comprising a variation of the second embodiment of the invention.
Figure 13:
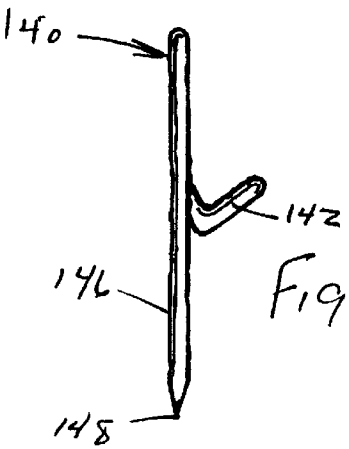
FIG. 13 is a side view of the apparatus of FIG. 11.

Referring to FIGS. 8, 9, and 10, there is shown a support system for cubicles 120 comprising a second variation of the first embodiment of the invention. The system 120 includes a handle 122 which may be formed from any of the wide variety of plastics utilized in the manufacture of household items, wood, ceramics, various metals, etc. The handle 122 has an inwardly curved upper surface 123, inwardly curved side surfaces 124 and 125, and inwardly curved bottom surface 126. The inwardly curved surfaces 123, 124, 125, and/or 126 receive two, three, or four fingers of the human hand to facilitate engagement of the system 120 with the fabric covered wall of a panel comprising a cubicle. The handle 122 further includes a nominally vertically disposed fabric engaging surface 127.

The support system 120 further includes a fabric and resilient layer penetrating member 128. The member 128 includes a first relatively short portion 130 and a second relatively long portion 132. The first portion 130 extends outwardly from the handle 122 perpendicularly to the fabric engaging surface 127. The second portion 132 extends perpendicularly from the first portion 130 and parallel to the fabric engaging surface 127. The second portion 132 terminates in a sharp fabric penetrating tip 134. The second portion 132 is approximately 15 times longer than the first portion 130.

Referring to FIGS. 11, 12, 13, and 14, there is shown a support system for cubicles 140 comprising a variation of the second embodiment of the invention. The support system 140 includes a hook 142 adapted to engage and support a variety of articles such as multi-page documents, pictures, framed photographs, etc. A pair of fabric engaging arms 144 extend outwardly from the hook 142 in opposite directions. Each arm 144 extends to a nominally vertically disposed fabric penetrating member 146 which in turn extends to a fabric penetrating tip 148.

In the use of the support system 140, the tips 148 are simultaneously engaged with the fabric comprising the interior surface 114 of a panel 112 of a cubicle 110. The tips 148 penetrate through the fabric and into the underlying resilient layer. The fabric penetrating members 146 follow the tips 148 through the fabric and into the underlying resilient layer. Inward movement of the tips 148 and the members 146 continues until the arms 144 engage the fabric comprising the interior surface 114 of the panel 112.

Engagement of the members 146 with the resilient layer underlying the fabric comprising the interior surface of the panel 112 secures the support system 140 thereto. Thereafter, the hook 142 is used to receive multi-page documents, pictures, and framed photographs, etc.

Although preferred embodiments of the invention have been illustrated in the accompanying drawings and described in the foregoing Detailed Description, it will be understood that the invention is not limited to the embodiments disclosed, but is capable of numerous rearrangements, modifications, and substitutions of parts and elements without departing from the spirit of the invention.

I claim:

1. A support system for use in conjunction with cubicles having an interior surfaces comprising a fabric layer and an underlying resilient layer comprising:

a plastic handle having a triangularly shaped, planar, nominally horizontally disposed upper surface, a triangularly shaped, planar, nominally vertically disposed document engaging rear surface and an angularly disposed surface extending from an apex at the distal end of the planar, nominally horizontally disposed upper surface to the lower end of the planar, nominally vertically disposed document engaging rear surface;

a document, fabric and resilient layer penetrating member including a short first portion extending rearwardly from the handle perpendicularly to the document engaging rear surface thereof and a long second portion extending perpendicularly to the first portion and parallel to the document engaging rear surface of the handle and extending to a sharp tip at the distal end thereof;

the long second portion of the document fabric and resilient layer penetrating member being substantially longer than the short first portion thereof;

the tip and the second portion of the document, fabric and resilient layer penetrating member being adapted to extend vertically downwardly through a document and through the fabric layer into the resilient layer and the first portion of the document, fabric and resilient layer penetrating member extending horizontally inwardly through the document and the fabric for supporting the document with the document engaging surface of the handle engaging the document along substantially the entire document surface thereof thereby securing the document at a predetermined location on an interior wall of the cubicle;

whereby the document engaging triangularly shaped planar rear surface is free of obstructions to permit the document to be secured along substantially the entire document engaging surface.

2. The support system according to claim 1 wherein the long second portion of the fabric and resilient layer penetrating member is about 15 times longer than the short first portion thereof.

3. A support system for use in conjunction with cubicles having an interior surfaces comprising a fabric layer and an underlying resilient layer comprising:

a plastic handle having a nominally vertically disposed triangularly shaped planar document engaging rear surface, an inwardly curved upper surface, opposed inwardly curved side surfaces, and an inwardly curved bottom surface, the inwardly curved top, side, and bottom surfaces being engageable by two, three, or four fingers of the human hand to facilitate use of the support system;

a document, fabric and resilient layer penetrating member including a short first portion extending rearwardly from the handle perpendicularly to the document engaging rear surface thereof and a long second portion extending perpendicularly to the first portion and parallel to the document engaging rear surface of the handle and extending to a sharp tip at the distal end thereof;

the long second portion of the document fabric and resilient layer penetrating member being substantially longer than the short first portion thereof;

the tip and the second portion of the document, fabric and resilient layer penetrating member being adapted to extend vertically downwardly through a document and through the fabric layer into the resilient layer and the first portion of the document, fabric and resilient layer penetrating member extending horizontally inwardly through the document and the fabric for supporting the document with the document engaging surface of the handle engaging the document along substantially the entire document surface thereof thereby securing the document at a predetermined location on an interior wall of the cubicle;

whereby the triangularly shaped planar document engaging rear surface is free of obstructions to permit the document to be secured along substantially the entire document engaging surface.

4. The support system according to claim 3 wherein the long second portion of the fabric and resilient layer penetrating member is about 15 times longer than the short first portion thereof.

* * * * *